US006858333B2

(12) United States Patent
Henderer

(10) Patent No.: US 6,858,333 B2
(45) Date of Patent: Feb. 22, 2005

(54) TOOL WITH WEAR RESISTANT LOW FRICTION COATING AND METHOD OF MAKING THE SAME

(75) Inventor: Willard E. Henderer, Evans, GA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 10/267,387

(22) Filed: Oct. 9, 2002

(65) Prior Publication Data

US 2004/0072038 A1 Apr. 15, 2004

(51) Int. Cl.[7] ..... B32B 9/00

(52) U.S. Cl. ..... 428/698; 428/697; 428/699; 428/704; 428/220; 428/336; 407/119; 51/309

(58) Field of Search ..... 428/446, 690, 428/689, 697, 698, 699, 704, 220, 332, 336; 407/119; 51/307, 309

(56) References Cited

U.S. PATENT DOCUMENTS

| | | | | |
|---|---|---|---|---|
| 3,788,177 | A | 1/1974 | Williamson | 83/454 |
| 3,788,192 | A | 1/1974 | Krieg | 90/40 |
| 4,594,294 | A * | 6/1986 | Eichen et al. | |
| 4,619,865 | A | 10/1986 | Keem et al. | 428/333 |
| 4,643,951 | A | 2/1987 | Keem et al. | 428/469 |
| 4,708,542 | A | 11/1987 | Emanuelli | 408/144 |
| 4,724,169 | A | 2/1988 | Keem et al. | 427/249 |
| 4,975,340 | A | 12/1990 | Suhr et al. | 428/698 |
| 4,992,153 | A | 2/1991 | Bergmann et al. | 204/192.16 |
| 5,002,798 | A | 3/1991 | Donley et al. | 427/53.1 |
| 5,035,019 | A | 7/1991 | Dias | 10/152 |
| 5,100,701 | A | 3/1992 | Freller et al. | 428/215 |
| RE34,180 | E | 2/1993 | Nemeth et al. | 428/547 |
| 5,192,578 | A * | 3/1993 | Ramm et al. | |
| 5,268,216 | A | 12/1993 | Keem et al. | 428/216 |
| 5,330,853 | A | 7/1994 | Hofmann et al. | 428/697 |
| 5,525,134 | A | 6/1996 | Mehrotra et al. | 51/307 |
| 5,580,653 | A | 12/1996 | Tanaka et al. | 428/336 |
| 5,707,748 | A | 1/1998 | Bergmann | 428/469 |
| 5,750,247 | A | 5/1998 | Bryant et al. | 428/323 |
| 5,766,742 | A | 6/1998 | Nakamura et al. | 428/210 |
| 5,830,531 | A | 11/1998 | Bergmann | 427/249 |
| 5,882,778 | A * | 3/1999 | Sugizaki et al. | |
| 5,965,253 | A | 10/1999 | Rechberger et al. | 428/336 |
| 6,204,213 | B1 * | 3/2001 | Mehrotra et al. | |
| 6,274,249 | B1 | 8/2001 | Braendle et al. | 428/551 |
| 6,284,366 | B1 | 9/2001 | König et al. | 428/336 |
| 2002/0048696 | A1 * | 4/2002 | Kukino et al. | |
| 2003/0175536 | A1 * | 9/2003 | Penich et al. | |

FOREIGN PATENT DOCUMENTS

| | | |
|---|---|---|
| EP | 0842306 | 1/2000 |
| WO | 9927893 | 6/1999 |
| WO | 005385 | 9/2000 |

OTHER PUBLICATIONS

Dias, A.G., et al., "Development of TiN–Si3N4 Nano Composite Coatings for Wear Resistance Applications," Journal de Physique IV, 5 (1995), pp. 831–840.

(List continued on next page.)

*Primary Examiner*—Deborah Jones
*Assistant Examiner*—Wendy Boss
(74) *Attorney, Agent, or Firm*—Larry R. Meenan

(57) ABSTRACT

A coated tool such as, for example, a cutting tool for removing material from a workpiece or a forming tool for contacting a workpiece. The coated tool includes a substrate wherein the substrate with a coating scheme on the substrate. The coating scheme comprises an outer coating region wherein the outer coating region is in contact with the workpiece during operation. The outer coating region comprises at least one layer of tribological coating material. The coating scheme has an inner coating region that comprises at least one layer of a hard coating material. Optionally, there is an adhesion coating region on the substrate and in contact with the inner coating region and/or present between the outer coating region and the inner coating region.

24 Claims, 5 Drawing Sheets

OTHER PUBLICATIONS

Veprek, S. et al., "Recent Progress in the Superhard Nanocrystalline Composites: toward their industrialization and understanding of the orgin of the superhardness", Surface Coatingsand Technology, 108/109 (1998) pp. 138–147.

Beensh–Marchwicla, G., et al., "Structure of Thin Films Prepared by Cosputtering of Titanium and Aluminum or Titanium and Silicon," Thin Solid Films 82 (1981) pp. 313–320.

Rebouta, L., "Hard Nanocomposite Ti–Si–N Coatings Prepared by DC Reactive Magnetron Sputtering," Surface and Coatings Technology 133–134 (2000) pp. 234–239.

Chen, M.Y., et al., "Synthesis and Tribological Properties of Carbon Nitride as a Novel Superhard Coating and Solid Lubricant" STLE Tribology Transactions vol. 36 (1993) pp. 491–495.

Fox, V.C, Teer, D.G., et al. "The Structure of Improved Tribologically Improved MoSz–Metal Composite Coatings and Their Industrial Applications", Surface and Coatings Technology 116–119 (1999) pp. 492–497.

Yang, S., Teer, D.G., "Investigation of Sputtered Carbon and Carbon Chromium Multi–Layered Coatings", Surface and Coatings Technology, 131 (2000) pp. 412–416.

Chen, Y.H., et al., "Synthesis and Structure of Smooth, Superhand TiN/SiNx Multilayer Coatings with an Equiaxed Microstructure", ICMCTF (2001) pp. 1–20.

Holubar, P., et al., "Nanocomposite nc–TiAiSiN and nc–TiN–BN coatings: their applications on substrates made of cemented carbide and results of cutting tests", Surface Coating Technology 120/121 (1999) pp. 184–188.

Shizhi, L. et al., "Ti–Si–N Films Prepared by Plasma–Enhanced Chemical Vapor Deposition" Plasma Chemistry and Plasma Processing, 12 (1992) pp. 287–297.

* cited by examiner

TOOL WITH WEAR RESISTANT LOW FRICTION COATING AND METHOD OF MAKING THE SAME

FIELD OF THE INVENTION

The invention pertains to a coated tool (such as, for example, a metalcutting tool and a metal forming tool), as well as a method of making a coated tool, wherein the tool includes a substrate with a wear resistant, low friction coating scheme thereon. The coating scheme includes an outer tribological coating region and an inner hard coating region. As one option, there is an adhesion coating region on the surface of the substrate and in contact with the inner hard coating region. As another option, there is an adhesive coating region between the outer tribological coating region and the inner hard coating region. Either one of the above options may exist either alone or in combination with one another.

BACKGROUND OF THE INVENTION

It is well known that cutting tools generate temperatures that are high enough to limit the life of the tool, thereby reducing the effective useful cutting speed. The temperature that is generated during cutting or forming depends on the frictional properties between the tool and the work material. The wear rate can be reduced and the performance of cutting tools can be improved by reducing friction which, in turn, reduces the temperature.

Transition metals such as titanium, vanadium and chromium (elements from groups IVa, Va, VIa in the Periodic Chart) form compounds with the elements boron, carbon, nitrogen and oxygen. These refractory compounds have been commonly used as coatings for cutting tools since they possess excellent properties for coatings (e.g., high temperature strength (hardness), abrasive wear resistance, extreme chemical stability and limited solubility in the work material). When these refractory materials are used alone as a coating for a cutting tool, they do not necessarily possess lubricious properties.

Molybdenum disulfide has lubricious properties. U.S. Pat. No. 5,002,798 to Donley et al. and U.S. Pat. No. 4,975,340 to Suhr et al. each disclose a method to produce a molybdenum disulfide film.

U.S. Pat. No. 5,965,253 to Rechberger et al. appears to disclose the use of a molybdenum disulfide layer on a cutting tool. Although in very general terms, the Rechberger et al. Patent seems to suggest at Column 4, lines 48–51 thereof the use of a molybdenum disulfide layer on the surface of a hard material (e.g., carbides, nitrides, carbonitrides and oxides).

U.S. Pat. No. 5,707,748 to Bergmann (and U.S. Pat. No. 5,830,531 to Bergmann) appears to disclose the use of a hard layer on the cutting tool and a friction-reducing layer on the hard layer. Bergmann suggests the use of carbon or carbides (e.g., tungsten carbide, chromium carbide, silicon carbide and titanium carbide)/carbon combinations. U.S. Pat. No. 4,992,153 to Bergmann appears to disclose the method of applying the coatings of the Bergmann patents (U.S. Pat. Nos. 5,707,748 and 5,830,531).

U.S. Pat. No. 6,284,366 B1 to König et al. appears to disclose a cutting tool that has a hard layer next to the substrate. An outer layer of molybdenum disulfide is on the hard layer. A thin metallic film (e.g., titanium carbide, titanium carbonitride, zirconium carbonitride) can be on the molybdenum disulfide layer. In the alternative, the molybdenum disulfide layer may be multi-layer with alternating layers of molybdenum disulfide and a metallic film.

PCT Patent Publication No. WO 00/55385 to Teer et al. [entitled METHOD AND CUTTING TOOL FOR CUTTING OF WORKPIECES] discloses a coating for cutting tools that possesses lubricious properties. The top coating layer is a carbon-based material wherein the carbon-carbon bonding is mostly of the graphite sp2 form. Sputtering is the preferred method to apply the coating. The preferred method is closed field unbalanced magnetron sputtering plating (CFUBMSIP). As one alternative, a metal-containing underlayer is very helpful for adhesion. This PCT document also discloses alternating layers of a metal-containing material and the carbon material. Preferred metals are chromium and titanium. Claim 9 discloses a first hard layer of a nitride, carbide carbonitride or boride and then a carbon layer. It seems that WO 00/55385 may address the broad concept of a hard layer-tribological layer scheme.

International Publication WO 99/27893 to Teer et al. [entitled CARBON COATINGS, METHOD AND APPARATUS FOR APPLYING THEM, AND ARTICLES BEARING SUCH COATINGS] discloses the method to apply the carbon coatings of WO 00/55385 discussed above. This document discloses alternating layer of metal-containing layers and carbon layers. Like in WO 00/55385, the WO 99/27893 document identifies chromium and titanium as the preferred metal components. The sputtering may also take place in a nitrogen atmosphere so as to form metal nitrides and metal carbonitrides. The focus is on a medical prosthesis.

European Patent 0 842 306 B1 to Teer et al. relates to metal-sulfur coating layers such as, for example, molybdenum disulfide. This patent discloses coating sequences of $MoS_2$/TiN or $MoS_2$/Ti. At page 7, lines 10–18, possible coatings are identified as follows: $MoS_2$ directly on the substrate; a (usually thin) layer of Ti followed by a $MoS_2$ coating; a (usually thin) layer of TiN followed by a $MoS_2$ coating; a (usually thin) layer of Ti followed by a mixture of $MoS_2$ with up to 40% titanium ($MoS_2$/Ti layer); a (usually thin) layer of TiN followed by a mixture of $MoS_2$ with up to 40% TiN ($MoS_2$/TiN layer); a mixture of $MoS_2$ with up to 40% titanium directly on the substrate; and a mixture of $MoS_2$ with up to 40% TiN directly on the substrate.

U.S. Pat. No. 4,619,865 to Keem et al. (and U.S. Pat. Nos. 4,643,951 and 4,724,169) appear to disclose a multi-layer coating scheme in which there could be a hard layer and a lubricious layer.

U.S. Pat. No. 5,100,701 to Freller et al. appears to disclose a hard layer (e.g., titanium nitride) with pores. These pores are intended to receive solid lubricant (e.g., molybdenum disulfide).

In some instances the top lubricious layer may include a metallic additive. In this regard, top surface layers appear to have been formed by co-depositing molybdenum disulfide and titanium to cutting tools first coated with titanium nitride and titanium aluminum nitride (Fox, V. C., Teer, D. G., et al., "The Structure of Inproved Tribologically Improved MoS2-Metal Composite Coatings and Their Inductrial Applications," Surface and Coatings Technology 116–119 (1999) 492–497). Along these same lines, the addition of a top surface layer of molybdenum disulfidetitanium to titanium nitride and titanium aluminum nitride coatings improved the life of high speed steel drills as compared to tools that only had a coating of titanium nitride or titanium aluminum nitride.

In regard to the lubricious layer, carbon and C/Cr films have been found to have good tribological properties (Yang, S., Teer, D. G., "Investigation of Sputtered Carbon and Carbon/Chromium Multi-Layered Coatings," Surface and Coatings Technology, 131 (2000) 412–416. U.S. Pat. No. 5,268,216 to Keem et al. shows alternating layers of molybdenum disulfide and a metal (e.g., nickel, gold or silver). In addition, carbon nitride films $CN_x$, have good tribological properties (Chen, Y. H., et al., "Synthesis and Structure of Smooth, Superhard TiN/SiNx Multilayer Coatings with an Equiaxed Microstructure," ICMCTF 2001).

Heretofore, hard coatings have included one or more of titanium, aluminum and silicon along with nitrogen. These coatings have been used in conjunction with cutting tools.

Nanolayers of titanium aluminum silicon nitride have shown good properties for cutting tools (Holubar,P., Jilek, M., Sima, M., Surface Coating Technology 120/121 (1999) 184–188). These types of composite coatings have been formed by simultaneously co-depositing titanium (or titanium and aluminum) and silicon, and reacting it with nitrogen by a variety of methods described in a number of articles [see Shizzhi,L. et al., "Ti—Si—N Films Prepared by Plasma-Enhanced Chemical Vapor Deposition," Plasma Chemistry and Plasma Processing, 12 (1992) 287–297; Dias, A. G., et al., "Development of TiN—Si3N4 Nano Composite Coatings for Wear Resistance Applications," Journal de Physique IV, 5 (1995), 831–840; Veprek, S., et al., Surface Coating and Technology, 108/109 (1998); Holubar, P. et al.; Beensh-Marchwick, G., et al., "Structure of Thin Films Prepared by Cosputtering of Titanium and Aluminum or Titanium and Silicon," Thin Solid Films 82 (1981) 313–320 and Rebouta, L., "Hard Nanocomposite Ti—Si—N Coatings Prepared by DC Reactive Magnetron Sputtering," Surface and Coatings Technology 133–134 (2000) 234–239].

U.S. Pat. No. 5,580,653 to Tanaka et al. describes single layer coatings aluminum titanium silicon nitride and aluminum titanium silicon carbonitride used on cutting tools for improved wear resistance.

U.S. Pat. No. 6,274,249 to Brauendle et al. describes specific tools (carbide end mills) coated with single layer Me(C,N) where Me comprises titanium and aluminum, and optionally at least one element such as B, Zr, Hf, Y, Si, W, Cr.

U.S. Pat. No. 5,330,853 to Hoffman et al. discloses multi-layer titanium-aluminum-nitride coating scheme for cutting tools. Silicon may be an element in the coating.

Another example of a coating scheme comprises a layered composite coating with nanometer thick alternating layers of TiN (or TiAlN), and SiN. Owing to its improved hardness properties, a composite layered TiN/SiN coating is reported to have one-third the wear rate of TiN (Chen, M-Y. et al., "Synthesis and Tribological Properties of Carbon Nitride as a Novel Superhard Coating and Solid Lubricant," journal and date unknown), Northwestern University.) The refractory layer may be further improved by incorporating the one or more of alloying elements Cr, Mo, Nb, Y to monolayer TiSiN, to TiN in multilayer TiN/SiN, and to TiAIN in multilayer TiAIN/SiN coatings.

SUMMARY OF THE INVENTION

In one form, the invention is a coated cutting tool for removing material from a workpiece. The cutting tool comprises a substrate wherein the substrate has a rake surface and a flank surface, and a cutting edge is at the intersection of the rake and flank surfaces. A coating is on the cutting edge and on at least a portion of one or both of the rake surface and the flank surface of the substrate. The coating includes an outer region wherein the outer region is in contact with the workpiece during a material removal operation. The outer region comprises at least one layer of tribological coating material. The coating includes an inner region that comprises at least one layer of a hard coating material wherein the inner region includes at least one transitional metal selected from the elements in Group IVa, Va and VIa of the Periodic Chart (for example, titanium) and silicon and nitrogen.

In another form, the invention is a coated cutting tool for removing material from a workpiece. The cutting tool comprises a substrate wherein the substrate has a rake surface and a flank surface, and a cutting edge is at the intersection of the rake and flank surfaces. A coating is on the cutting edge and at least a portion of one or both of the rake surface and the flank surface of the substrate. The coating comprises an outer region wherein the outer region is in contact with the workpiece during a material removal operation. The outer region comprises at least one layer containing molybdenum and sulfur. The coating further includes an inner region that comprises alternating layers of a first material that contains a transition metal selected from Group IVa, Va and VIa of the Periodic Chart (for example, titanium) and nitrogen and a second material that contains silicon and nitrogen.

In yet another form thereof, the invention is a coated cutting tool for removing material from a workpiece. The cutting tool comprises a substrate wherein the substrate has a rake surface and a flank surface, and a cutting edge is at the intersection of the rake and flank surfaces. A coating is on the cutting edge and at least a portion of one or both of the rake surface and the flank surface of the substrate. The coating comprises an outer tribological region wherein the outer region is in contact with the workpiece during a material removal operation. The coating includes an inner region that comprises alternating layers of a first material that contains titanium and aluminum and nitrogen, and a second material that contains silicon and nitrogen.

In still another form thereof, the invention is a coated forming tool for contacting a workpiece so as to displace material into a shape. The forming tool comprises a substrate that has a contact surface for contacting the workpiece, and a coating on the contact surface of the substrate. The coating comprises an outer region wherein the outer region is in contact with the workpiece during a forming operation. The outer region comprising at least one layer of tribological coating material. The coating includes an inner region comprising at least one layer of a hard coating material wherein the inner region includes at least one transitional metal selected from the elements in Group IVa, Va and VIa of the Periodic Chart (for example, titanium) and silicon and nitrogen.

In yet another form thereof, the invention is a coated forming tool for contacting a workpiece so as to displace material into a shape. The forming tool comprises a substrate wherein the substrate has a contact surface, and a coating is on the contact surface of the substrate. The coating comprises an outer region wherein the outer region is in contact with the workpiece during a forming operation. The outer region comprises at least one layer containing molybdenum and sulfur. The coating comprises an inner region comprising alternating layers of a first material that contains a transition metal selected from Group IVa, Va and VIa of the Periodic Chart (for example, titanium) and nitrogen and a second material that contains silicon and nitrogen.

BRIEF DESCRIPTION OF THE DRAWINGS

The following is a brief description of the drawings which form a part of this patent application.

DESCRIPTION OF THE INVENTION

Figure 1:
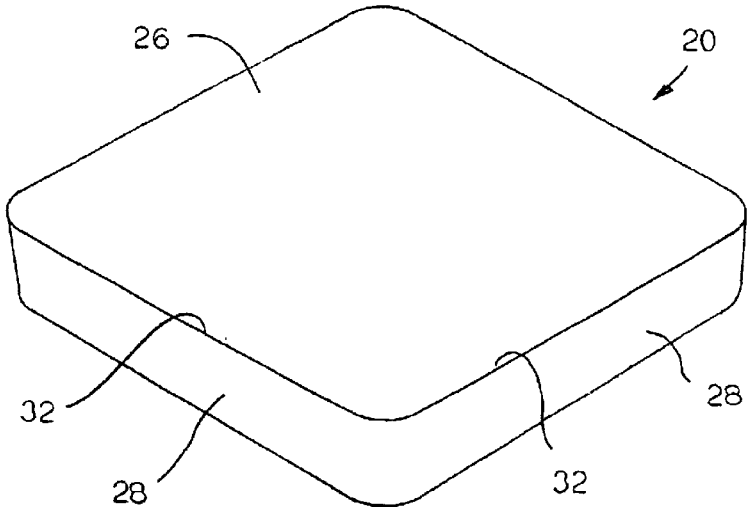
FIG. 1 is an isometric view of a cutting tool.

The invention concerns a coated tool (such as, for example, a coated metalcutting tool or a coated forming tool) that has a substrate that has a wear resistant, low friction coating scheme applied thereto. Typical cutting tool applications include turning, threading, milling, drilling, reaming, boring, tapping, planning, broaching and sawing. Typical forming tools include forming and drawing dies, punches, thread (external) forming tools, and thread (internal) forming taps. The substrate typically comprises a tool steel (including high-speed steel), a cemented carbide, a ceramic or a cermet.

One common cemented carbide is a tungsten carbide-cobalt material. Exemplary tungsten carbide-cobalt substrates are disclosed in U.S. Pat. No. 5,750,247 to Bryant et al. Another suitable tungsten carbide-cobalt substrate presents a surface zone of cobalt (binder) enrichment. Exemplary substrates that have a surface zone of binder enrichment are disclosed in U.S. Pat. No. Re 34,180 to Nemeth, deceased et al. Other possible substrate materials are ceramics and cermets.

One common ceramic material for a substrate (e.g., the substrate of a metalcutting tool) is a silicon nitride-based material. This type of ceramic substrate is disclosed in U.S. Pat. No. 5,525,134 to Mehrotra et al.

A possible type of cermet substrate is a titanium carbonitride-based material. U.S. Pat. No. 5,766,742 to Nakamura et al. discloses this type of cermet substrate.

The wear resistant, low friction coating scheme comprises two basic coating regions. One region is a top coating region. The surface of the top region is in contact with the workpiece during the cutting operation. The top coating region typically includes at least one layer (or multiple layers) of tribological coating material that has good overall tribological properties (including good lubricity).

The top outer region may comprise a single layer of molybdenum disulfide. As an alternative, the top outer region comprises a single layer of molybdenum disulfide and a metallic additive. Typical metallic additives include molybdenum, tungsten, chromium, niobium and titanium. The metallic addition may comprise a single metal or a combination of any two or more of these metallic additives. When the top outer coating region comprises a single layer, the thickness thereof is between about 0.1 micrometers and about 10 micrometers.

As an alternative to depositing molybdenum disulfide and the metallic addition as one layer, one can deposit alternating layers of molybdenum disulfide and the metallic addition. One example is the deposition of alternating layers of molybdenum disulfide and titanium. Another example is the deposition of molybdenum disulfide and chromium. In addition to titanium and chromium, other candidates for the metallic addition include molybdenum, tungsten and niobium. Each individual layer of this alternating layer coating scheme (molybdenum disulfide and a metallic addition) has a thickness that ranges between about 0.1 nanometers and about 500 nanometers. The total thickness of this alternating layer of molybdenum disulfide and the metallic addition ranges between about 0.1 micrometers and about 10 micrometers.

As still another alternative to the above schemes for the top outer coating region, one may deposit a single layer of carbon. The single layer of carbon has a thickness that is between about 0.1 micrometers and about 10 micrometers. As an alternative to the single carbon layer, alternating layers of carbon and a transition metal such as, for example, either chromium or titanium may be deposited to form the top coating region. The thickness of each layer of carbon and chromium (or titanium) may range between about 0.1 nanometers and about 500 nanometers. The total thickness of the alternating layers of carbon and chromium or titanium ranges between about 0.1 micrometers and about 10 micrometers.

As yet another alternative to the above schemes for the top outer coating region, applicant contemplates a carbon nitride ($CN_x$) layer or layers. The value of x may range between about 0.01 and about 1.00. The thickness of a single layer of carbon nitride may range between about 0.1 micrometer and about 10 micrometers. In the case of multiple layers of carbon nitride, the total thickness would range between about 0.1 micrometer and about 10 micrometers.

As still another option for the top outer coating region, applicant contemplates alternating layers of carbon and a transition metal carbide wherein the transition metal is selected from Group IVa, Group Va and Group VIa of the Periodic Chart, for example, tungsten carbide. The thickness of each layer of carbon and metal carbide (e.g., tungsten carbide) may range between about 0.1 nanometers and 500 nanometers. The total thickness of the alternating layers equals between about 0.1 micrometers and about 10 micrometers.

As still another alternative for the top outer coating region, carbon and the transition metal carbide can be co-deposited to form a single layer that comprises the top outer coating region. In the case of a single layer of carbon and a transition metal carbide, the thickness of that single layer may range between about 0.1 micrometers and about 10 micrometers.

The second inner coating region comprises a hard, refractory coating scheme. The hard, refractory coating scheme may, as one alternative, comprise alternating coating layers of titanium nitride and silicon nitride. The titanium nitride layer in this usage and in other usages mentioned herein has the formula $TiN_x$ wherein x ranges between about 0.6 and about 1.0. The silicon nitride layer in this usage and in other usages mentioned herein may have the formula $SiN_X$ wherein x ranges between about 0.75 to about 1.333 or $Si_3N_4$. Each individual layer has a thickness that ranges between about 0.1 nanometers and about 500 nanometers. The total thickness of the alternating layers of titanium nitride and silicon nitride ranges between about 0.5 micrometers and about 20 micrometers.

As another alternative, the hard, refractory coating scheme may comprise alternating layers of titanium aluminum nitride and silicon nitride. The titanium aluminum nitride in this usage and in other usages mentioned herein has the formula $(Ti_xAl_{1-x})N_y$ wherein x ranges between about 0.25 and about 0.75, and y ranges between about 0.6 and about 1.0. Each individual layer has a thickness that ranges between about 0.1 nanometers and about 500 nanometers. The total thickness of the alternating layers of titanium aluminum nitride and silicon nitride ranges between about 0.5 micrometers and about 20 micrometers.

It should be appreciated that there may be some instances in which the use of the alternating layers of titanium aluminum nitride and silicon nitride may be appropriate in the absence of any other coating scheme that has good tribological properties. The properties of the alternating layers of titanium aluminum nitride and silicon nitride used in the absence of a coating scheme with good tribological properties would be expected to provide good performance in various applications such as, for example, cutting tools and forming tools.

As still another alternative for the hard, refractory coating scheme, one may codeposit titanium and silicon in a reactive nitrogen atmosphere to deposit a single layer (or multiple layers) of titanium silicon nitride. In this usage, as well as in other usages mentioned hereinafter, the titanium silicon nitride has the formula $(Ti_{1-x}Si_x)N_y$ wherein x ranges between about 0.01 and about 0.30, and y ranges between about 0.6 and about 1.1. The single layer may have a thickness that ranges between about 0.5 micrometers and about 20 micrometers.

In addition to the top outer coating region and the hard, refractory coating region, there may be an adherence coating scheme. The adherence coating scheme is applied directly to the surface of the substrate. The adherence coating scheme may comprise one or more layers of metals such as, for example, aluminum, silicon, or a transition metal such as, for example, titanium or chromium. The adherence layer may also comprise one or more layers of a nitride of the above elements; namely, aluminum nitride, silicon nitride, and transition metal nitrides such as, for example, titanium nitride and chromium nitride. As an alternative, the adherence layer may comprise the metal layer followed by metal nitride layer. For example, a titanium layer may be followed by a titanium nitride layer. The thickness of the adherence coating region is between about 1 nanometer and about 3000 nanometers.

An adherence coating scheme may also be present so as to be between the top coating region and the hard, refractory coating region. The compositions and properties of this adherence coating scheme are the same as those described hereinabove for the adherence coating scheme that is between the hard, refractory coating region and the substrate.

Referring now to the drawings, there is shown several specific embodiments of coated metalcutting tools. The cutting tool shown in FIG. 1 is a cutting tool insert used frequently for applications such as, for example, turning and milling. Applicant contemplates that the invention has application in other metalcutting applications in addition to turning and milling. Furthermore, even though these specific embodiments of FIGS. 1–8 are metalcutting tools, applicant contemplates that the invention encompasses a broader range of tools than only metalcutting tools, such as, for example, forming tools. In this regard, FIG. 9 shows a cold forming tap.

Figure 2:
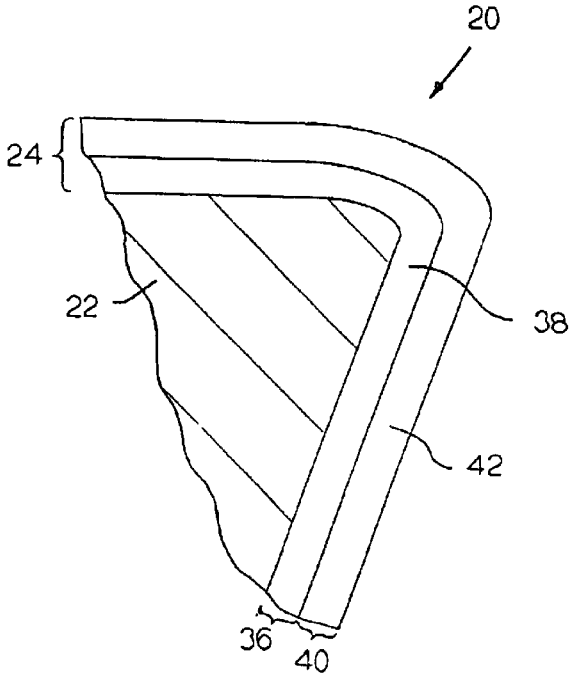
FIG. 2 is a cross-sectional view of the cutting tool of FIG. 1 showing one corner of the cutting tool so as to illustrate the substrate and a hard coating region of a single layer and an outer tribological coating region comprising a single layer.

Referring in particular to FIGS. 1 and 2, there is shown a cutting tool generally designated as 20. Cutting tool 20 has a substrate 22 (see FIG. 2) with a coating scheme shown in brackets 24 applied thereto. The cutting tool 20 has a rake surface 26 and flank surfaces 28. There are cutting edges 32 at the intersection of the rake surface 26 and the flank surfaces 28.

Referring to FIG. 2, which is a cross-section through the cutting edge of the cutting tool, the coating scheme 24 includes an inner region 36 and an outer region 40. In this specific embodiment, the inner region 36 comprises a single layer 38 of a hard material. In this regard, the single layer 38 that comprises the inner coating region 36 may comprise titanium silicon nitride. The outer region 38 also comprises a single layer 42 of a lubricious material with good tribological properties. In this regard, the single layer 42 may comprise molybdenum disulfide.

Figure 3:
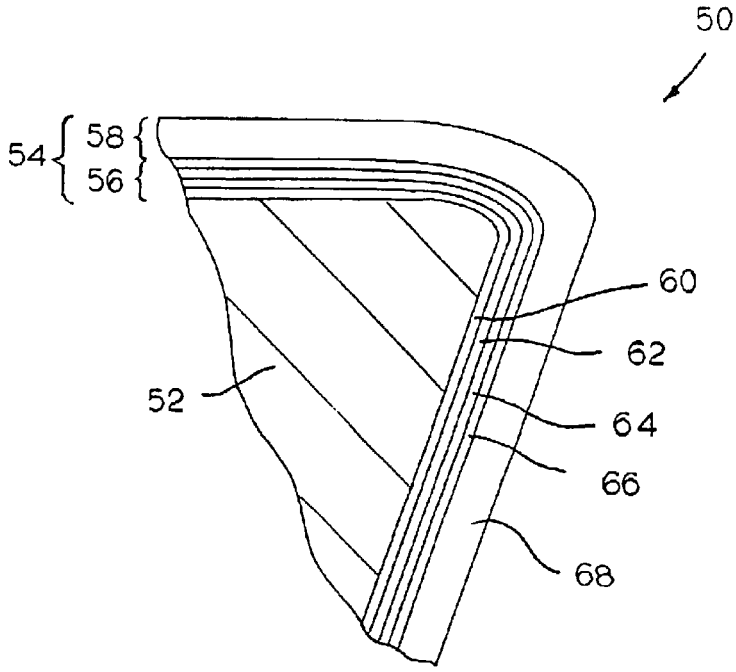
FIG. 3 is a cross-sectional view of another specific embodiment of a cutting tool showing the corner wherein there is shown a substrate and an inner hard coating region comprising multiple layers and an outer tribological coating region comprising a single layer.

Referring to FIG. 3, there is shown a cross-section through the cutting edge of another specific embodiment of the cutting tool of the invention wherein the cutting tool is generally designated as 50. The cutting tool 50 comprises a substrate 52 and a coating scheme (shown in brackets 54) on the substrate 52. The coating scheme 54 has an inner coating region 56 and an outer coating region 58.

In this embodiment, the inner coating region 56 comprises four layers (60, 62, 64, 66). It should be appreciated that the illustration of four layers is only by way of example. It is contemplated that different numbers of layers, which is generally more than four, may comprise the inner coating region 56 depending upon the thickness of each layer and the total thickness of the inner coating region 56. It is typical that these layers are alternating layers of two different materials. In this regard, the inner coating region 56 may comprise alternating layers of titanium nitride and silicon nitride. Each layer has a thickness in the range of between about 0.1 nanometers and about 500 nanometers.

The outer coating scheme 58 comprises a single layer 68. The single layer 68 may comprise molybdenum disulfide.

The thickness of the single layer 68 may range between about 0.1 micrometers and about 10 micrometers.

Figure 4:
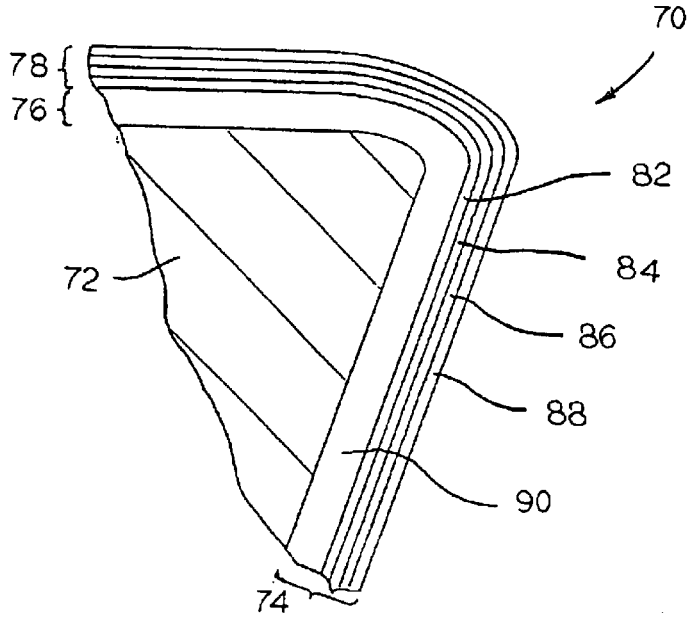
FIG. 4 is a cross-sectional view of another specific embodiment of a cutting tool showing the corner wherein there is shown a substrate and an inner hard coating region comprising a single layer and an outer tribological coating region comprising multiple layers.

Referring to FIG. 4, there is shown a cross-section through the cutting edge of another specific embodiment of the cutting tool of the invention wherein the cutting tool is generally designated as 70. The cutting tool 70 comprises a substrate 72 and a coating scheme 74 on the substrate 72. The coating scheme 74 has an inner coating region 76 and an outer coating region 78.

In this embodiment, the outer coating region 78 comprises four layers (82, 84, 86, 88). Is should be appreciated that the illustration of four layers is only by way of example. It is contemplated that different numbers of layers may comprise the outer coating region 78 depending upon the thickness of each layer and the total thickness of the outer coating region. It is typical that these layers are alternating layers of two different materials. In this regard, the outer coating region 78 may comprise alternating layers of carbon and chromium. Each layer has a thickness in the range of between about 0.1 nanometers and about 500 nanometers.

The inner coating scheme 76 comprises a single layer 90. The single layer 90 may comprise titanium silicon nitride. The thickness of the single layer 90 may range between about 0.5 micrometers and about 20 micrometers.

Figure 5:
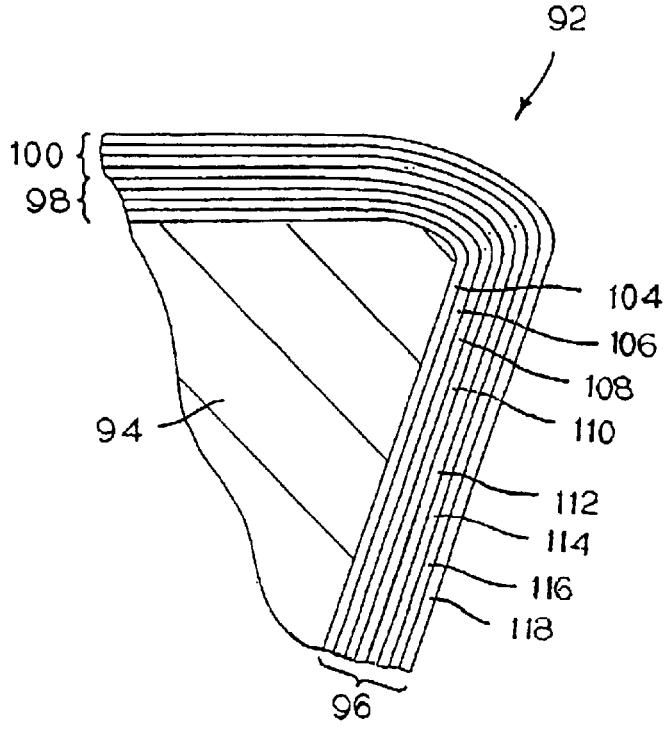
FIG. 5 is a cross-sectional view of another specific embodiment of a cutting tool showing the corner wherein there is shown a substrate and an inner hard coating region comprising multiple layers and an outer tribological coating region comprising multiple layers.

Referring to FIG. 5, there is shown a cross-section through the cutting edge of another specific embodiment of the cutting tool of the invention wherein the cutting tool is generally designated as 92. The cutting tool 92 comprises a substrate 94 and a coating scheme 96 on the substrate 94. The coating scheme 96 has an inner coating region 98 and an outer coating region 100.

In this embodiment, the inner coating region 98 comprises four layers (104, 106, 108, 110). It should be appreciated that the illustration of four layers is only by way of example. It is contemplated that different numbers of layers may comprise the inner coating region 98 depending upon the thickness of each layer and the total thickness of the inner coating region. It is typical that these layers are alternating layers of two different materials. In this regard, the inner coating region 98 may comprise alternating layers of titanium nitride and silicon nitride. Each layer has a thickness in the range of between about 0.1 nanometers and about 500 nanometers.

In this embodiment, the outer coating region 100 comprises four layers (112, 114, 116, 118). It should be appreciated that the illustration of four layers is only by way of example. It is contemplated that different numbers of layers may comprise the outer coating region 100 depending upon the thickness of each layer and the total thickness of the outer coating region. It is typical that these layers are alternating layers of two different materials. In this regard, the outer coating region 100 may comprise alternating layers of molybdenum disulfide and chromium. Each layer has a thickness in the range of between about 0.1 nanometers and about 500 nanometers.

Figure 6:
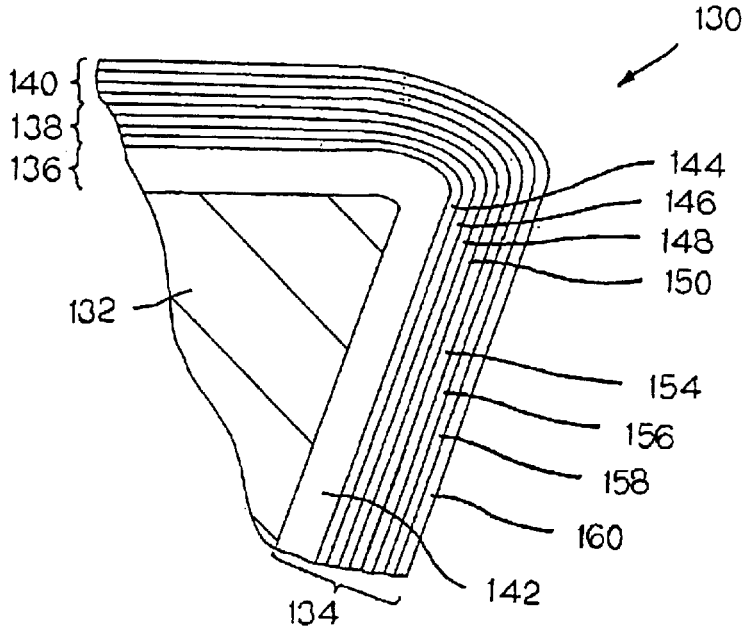
FIG. 6 is a cross-sectional view of another specific embodiment of a cutting tool showing the corner wherein there is shown a substrate and an inner hard coating region comprising multiple layers and an outer tribological coating region comprising multiple layers and an adhesion coating region comprising a single layer.

Referring to FIG. 6, there is shown a cross-section through the cutting edge of another specific embodiment of the cutting tool of the invention wherein the cutting tool is generally designated as 130. The cutting tool 130 comprises a substrate 132 and a coating scheme 134 on the substrate 132. The coating scheme 134 has an adhesion coating region 136, an inner coating region 138 and an outer coating region 140.

The adhesion coating region 136 comprises a single layer 142. Typically, this single layer 142 may comprise titanium.

The inner coating region 138 comprises four layers (144, 146, 148, 150). It should be appreciated that the illustration of four layers is only by way of example. It is contemplated that different numbers of layers may comprise the inner coating region 138 depending upon the thickness of each layer and the total thickness of the inner coating region. It is typical that these layers are alternating layers of two different materials. In this regard, the inner coating region 138 may comprise alternating layers of titanium nitride and silicon nitride. Each layer has a thickness in the range of between about 0.1 nanometers and about 500 nanometers.

The outer coating region 140 comprises four layers (154, 156, 158, 160). It should be appreciated that the illustration of four layers is only by way of example. It is contemplated that different numbers of layers may comprise the outer coating region 140 depending upon the thickness of each layer and the total thickness of the outer coating region. It is typical that these layers are alternating layers of two different materials. In this regard, the outer coating region 140 may comprise alternating layers of carbon and chromium. Each layer has a thickness in the range of between about 0.1 nanometers and about 500 nanometers.

Figure 7:
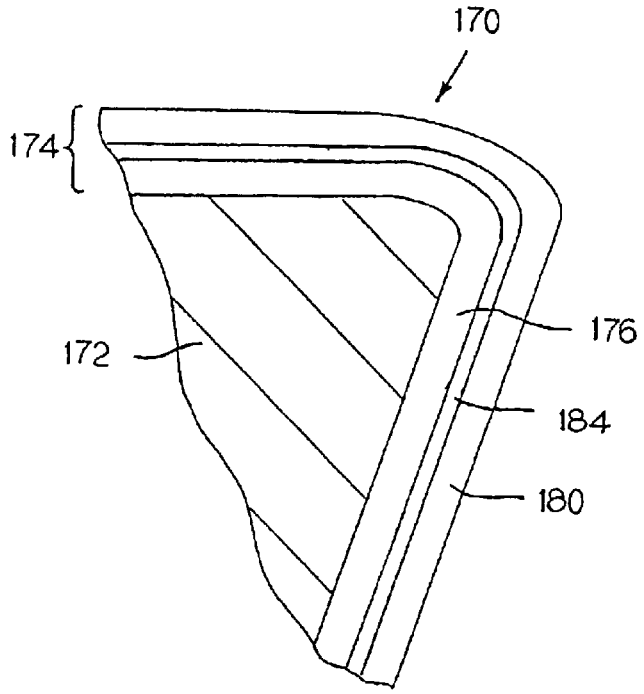
FIG. 7 is a cross-sectional view of another specific embodiment of a cutting tool showing the corner wherein there is shown a substrate and an inner hard coating region comprising a single layer and an outer tribological coating region comprising a single layer wherein there is an adherence coating layer between the inner coating region and the outer coating region.

Referring to FIG. 7, there is shown a cross-section through the cutting edge of still another specific embodiment generally designated as 170. Cutting tool 170 has a substrate 172 and a coating scheme 174 on the substrate 172.

The coating scheme 172 comprises a single inner coating region 176. The inner coating region 176 may comprise titanium silicon nitride and have a thickness that ranges between about 0.5 micrometers and about 20 micrometers.

The coating scheme 172 further includes an outer coating region 180 wherein the outer coating region 180 may comprise a single layer of carbon nitride. The thickness of the outer coating region 180 may range between about 0.1 micrometers and about 10 micrometers.

The coating scheme 172 also includes an adherence coating region 184 that comprises a single layer of titanium. The thickness of the adherence coating region may range between about 1 nanometer to about 3000 nanometers.

Figure 8:
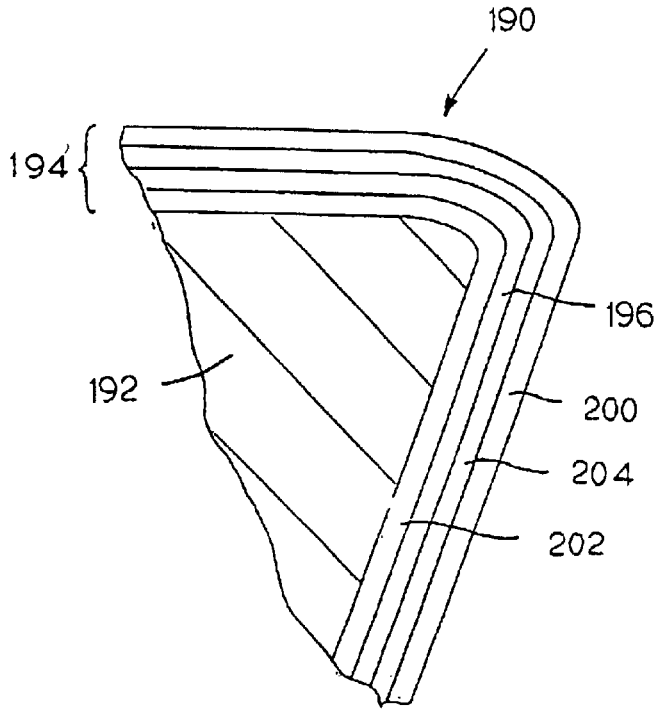
FIG. 8 is a cross-sectional view of another specific embodiment of a cutting tool showing the corner wherein there is shown a substrate and an inner hard coating region comprising a single layer and an outer tribological coating region comprising a single layer and an adhesion coating region comprising a single layer between the substrate and the inner coating region and another adherence coating region between the inner coating region and the outer coating region.
Figure 9:
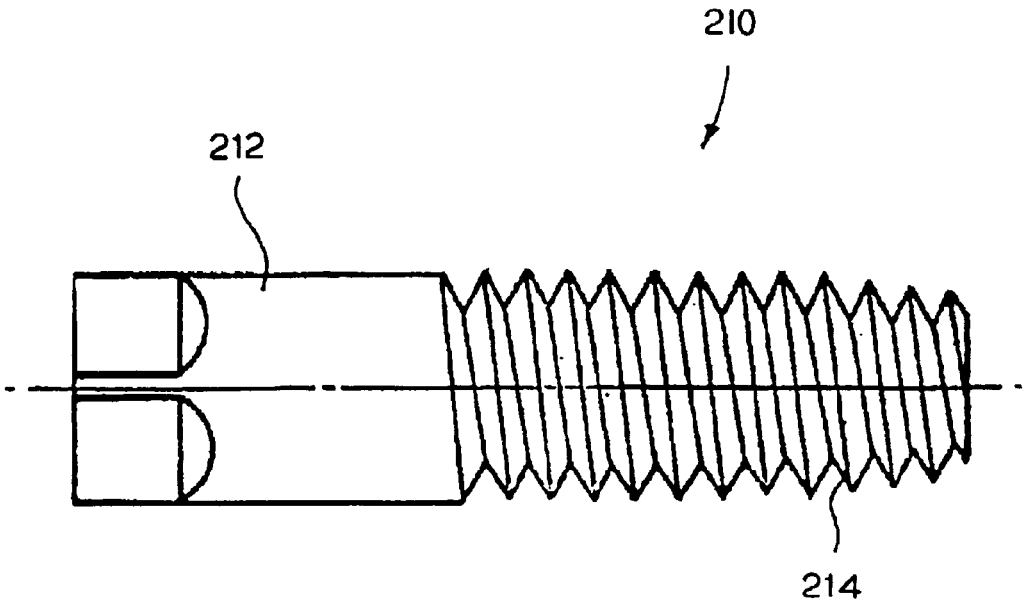
FIG. 9 is a side view of a cold forming tap that has a coating applied thereto.

Referring to FIG. 8, there is shown a cross-section through the cutting edge of still another specific embodiment generally designated as 190. Cutting tool 190 has a substrate 192 and a coating scheme 194 on the substrate 192.

The coating scheme 194 comprises a single inner coating region 196. The inner coating region 196 may comprise titanium silicon nitride and have a thickness that ranges between about 0.5 micrometers and about 20 micrometers.

The coating scheme 194 further includes an outer coating region 200 wherein the outer coating region 200 may comprise a single layer of molybdenum disulfide. The thickness of the outer coating region 200 may range between about 0.1 micrometers and about 10 micrometers.

The coating scheme 194 also includes two adherence coating regions 202 and 204 wherein each adherence coating region (202,204) comprises a single layer of titanium. The thickness of each one of the adherence coating regions may range between about 1 nanometer to about 3000 nanometers. One adherence coating region 202 is between the surface of the substrate 192 and the inner coating region 196. The outer adherence coating region 204 is between the inner coating region 196 and the outer coating region 200.

Referring to FIG. 9, there is shown a cold forming tap for forming threads wherein the tap is generally designated as 210. The tap 210 has an elongated body. A shank 212 is at one end of the elongated body. A threaded portion 214 is near the other end of the elongated body. Any one of the specific embodiments of the coating schemes disclosed hereinabove may be applied to the cold forming tap 210. In this regard, applicant contemplates that any one of the coating schemes disclosed herein for use in a cutting tool also has application as a coating for a forming tool such as, for example, a cold forming tap.

All patents, patent applications, articles and other documents identified herein are hereby incorporated by reference herein.

Other embodiments of the invention may be apparent to those skilled in the art from a consideration of the specification or the practice of the invention disclosed herein. It is intended that the specification and any examples set forth herein be considered as illustrative only, with the true spirit and scope of the invention being indicated by the following claims.

What is claimed is:

1. A coated cutting tool for removing material from a workpiece, the cutting tool comprising:

a substrate wherein the substrate has a rake surface and a flank surface, a cutting edge is at the intersection of the rake and flank surfaces;

a coating on the cutting edge and on at least a portion of one or both of the rake surface and the flank surface of the substrate;

the coating comprising an outer region wherein the outer region is in contact with the workpiece during a material removal operation;

the outer region comprising at least one layer of tribological coating material; and an inner region comprising at least one layer of a hard coating material wherein the hard coating material includes;

at least one transitional metal selected from the group consisting of Groups IVa, Va and VIa of the Periodic Chart, and silicon and nitrogen wherein the inner region comprising at least three alternating layers of titanium nitride and silicon nitride, and wherein the silicon nitride has the formula $SiN_x$ wherein x ranges between about 0.75 and about 1.333.

2. A coated cutting tool for removing material from a workpiece, the cutting tool comprising:

a substrate wherein the substrate has a rake surface and a flank surface, a cutting edge is at the intersection of the rake and flank surfaces;

a coating on the cutting edge and on at least a portion of one or both of the rake surface and the flank surface of the substrate;

the coating comprising an outer region wherein the outer region is in contact with the workpiece during a material removal operation;

the outer region comprising at least one layer of tribological coating material; and an inner region comprising at least one layer of a hard coating material wherein the hard coating material includes:

at least one transitional metal selected from the group consisting of Groups IVa, Va and VIa of the Periodic Chart, and silicon and nitrogen wherein the inner region comprising at least three alternating layers of titanium nitride and silicon nitride, and wherein the silicon nitride has the formula $Si_3N_4$.

3. A coated cutting tool for removing material from a workpiece, the cutting tool comprising:

a substrate wherein the substrate has a rake surface and a flank surface, a cutting edge is at the intersection of the rake and flank surfaces;

a coating on the cutting edge and on at least a portion of one or both of the rake surface and the flank surface of the substrate;

the coating comprising an outer region wherein the outer region is in contact with the workpiece during a material removal operation;

the outer region comprising at least one layer of tribological coating material; and an inner region comprising at least one layer of a hard coating material wherein the hard coating material includes:

at least one transitional metal selected from the group consisting of Groups IVa, Va and VIa of the Periodic Chart, and silicon and nitrogen;

the inner region comprising alternating layers of titanium aluminum nitride and silicon nitride wherein the silicon nitride has the formula $SIN_x$ wherein x ranges between about 0.75 and about 1.333.

4. The coated cutting tool according to claim 3 wherein each one of the layers of titanium aluminum nitride and silicon nitride has a thickness between about 0.1 nanometer and about 500 nanometers.

5. The coated cutting tool according to claim 3 wherein the titanium aluminum nitride further includes one or more elements selected from the group consisting of chromium, molybdenum, niobium and yttrium.

6. A coated cutting tool for removing material from a workpiece, the cutting tool comprising:

a substrate wherein the substrate has a rake surface end a flank surface, a cutting edge is at the intersection of the rake and flank surfaces;

a coating on the cutting edge and on at least a portion of one or both of the rake surface and the flank surface of the substrate;

the coating comprising an outer region wherein the outer region is in contact with the workpiece during a material removal operation;

the outer region comprising at least one layer of tribological coating material; and an inner region comprising at least one layer of a hard coating material wherein the hardcoating material includes;

at least one transitional metal selected from the group consisting of Groups IVa, Va and VIa of the Periodic Chart, and silicon and nitrogen;

the inner region comprising alternating layers of titanium aluminum nitride and silicon nitride wherein the silicon nitride has the formula, and wherein the silicon nitride has the formula $Si_3N_4$.

7. A coated cutting tool for removing material from a workpiece, the cutting tool comprising:

a substrate wherein the substrate has a rake surface and a flank surface, a cutting edge is at the intersection of the rake and flank surfaces;

a coating on the cutting edge and on at least a portion of one or both of the rake surface and the flank surface of the substrate;

the coating comprising an outer region wherein the outer region is in contact with the workpiece during a material removal operation;

the outer region comprising at least one layer of tribological coating material;

the coating comprising an inner region comprising at least one layer of a hard coating material wherein the hard coating material includes:

at least one transitional metal selected from the group consisting of Groups IVa, Va and VIa of the Periodic Chart, and silicon and nitrogen wherein the inner region comprising at least three alternating layers of titanium nitride and silicon nitride;

further including a first adherence region between the substrate and the inner region, and a second adherence region between the inner region and the outer region, and wherein the first adherence region comprising one layer comprising at least one transition metal selected from Group IVa, Va and VIa of the Periodic Chart, and another layer comprising a transition metal nitride wherein the metal is selected from Group IVa, Va, and VIa of the Periodic Chart; and the second adherence region comprising one layer comprising at least one transition metal selected from Group IVa, Va, and VIa of the Periodic Chart, and another layer comprising a transition metal nitride wherein the metal is selected from Group IVa, Va, and VIa of the Periodic Chart.

8. A coated cutting tool for removing material from a workpiece, the cutting tool comprising:

a substrate wherein the substrate has a rake surface and a flank surface, a cutting edge is at the intersection of the rake and flank surface;

a coating on the cutting edge and on at least a portion of one or both of the rake surface and the flank surface of the substrate;

the coating comprising an outer region wherein the outer region is in contact with the workpiece during a material removal operation;

the outer region comprising at least one layer of tribological coating material; and an inner region comprising at least one layer of a hard coating material wherein the hard coating material includes:

at least one transitional metal selected from the group consisting of Groups IVa, Va and VIa of the Periodic Chart, and silicon and nitrogen, wherein the outer region comprising a plurality of layers of molybdenum disulfide.

9. A coated cutting tool for removing material from a workpiece, the cutting tool comprising:

a substrate wherein the substrate has a rake surface and a flank surface, a cutting edge is at the intersection of the rake and flank surfaces;

a coating on the cutting edge and on at least a portion of one or both of the rake surface and the flank surface of the substrate;

the coating comprising an outer region wherein the outer region is in contact with the workpiece during a material removal operation;

the outer region comprising at least one layer of tribological coating material; and an inner region comprising at least one layer of a hard coating material wherein the hard coating material includes:

at least one transitional metal selected from the group consisting of Groups IVa, Va and VIa of the Periodic Chart, and silicon and nitrogen wherein the outer region comprising alternating layers of molybdenum disulfide and one or more materials selected from the group consisting of molybdenum, tungsten, chromium, niobium and titanium.

10. The coated cutting tool according to claim 9 wherein each one of the layers comprising the outer region has a thickness of between about 0.1 nanometer and about 500 nanometers.

11. A coated cutting tool for removing material from a workpiece, the cutting tool comprising:

a substrate wherein the substrate has a rake surface and a flank surface, a cutting edge is at the intersection of the rake and flank surfaces;

a coating on the cutting edge and on at least a portion of one or both of the rake surface and the flank surface of the substrate;

the coating comprising an outer region wherein the outer region is in contact with the workpiece during a material removal operation;

the outer region comprising at least one layer of tribological coating material; and an inner region comprising at least one layer of hard coating material wherein the hard coating material includes:

at least one transitional metal selected from the group consisting of Groups IVa, Va and VIa of the Periodic Chart, and silicon and nitrogen wherein the outer region comprising alternating layers of tungsten carbide and carbon.

12. The coated cutting tool according to claim 11 wherein each one of the layers of tungsten carbide and carbon comprising the outer region has a thickness of between about 0.1 nanometer and about 500 nanometers.

13. A coated cutting tool for removing material from a workpiece, the cutting tool comprising:

a substrate wherein the substrate has a rake surface and a flank surface, a cutting edge is at the intersection of the rake and flank surfaces;

a coating on the cutting edge and on at least a portion of one or both of the rake surface and the flank surface of the substrate;

the coating comprising an cuter region wherein the outer region is in contact with the workpiece during a material removal operation;

the outer region comprising at least one layer of tribological coating material; and an inner region comprising at least one layer of a hard coating material wherein the hard coating material includes:

at least one transitional metal selected from the group consisting of Groups IVa, Va, and VIa of the Periodic Chart, and silicon and nitrogen wherein the outer region comprises alternating layers of carbon and a transition metal carbide wherein the transition metal is selected from the group consisting of Groups IVa, Va, and VIa of the Periodic Chart.

14. A coated cutting tool for removing material from a workpiece, the cutting tool comprising:

a substrate wherein the substrate has a rake surface and a flank surface, a cutting edge is site intersection of the rake and flank surfaces;

a coating on the cutting edge and on at least a portion of one or both of the rake surface and the flank surface of the substrate;

the coating comprising an outs region wherein the outer region is in contact with the workpiece during a material removal operation;

the outer region comprising at least one layer of tribological coating material; and an inner region comprising at least one layer of a hard coating material wherein the hard coating material includes:

at least one transitional metal selected from the group consisting of Groups IVa, Va and VIa of the Periodic Chart, and silicon and nitrogen wherein the thickness of the outer region is between about 0.1 nanometers and about 10 nanometers.

15. A coated cutting tool for removing material from a workpiece, the cutting tool comprising:

a substrate wherein the substrate has a rake surface and a flank surface, a cutting edge is at the intersection of the rake and flank surfaces;

a coating on the cutting edge and on at least a portion of one or both of the rake surface end the flank surface of the substrate;

the coating comprising an outer region wherein the outer region is in contact with the workpiece during a material removal operation;

the outer region comprising at least one layer tribological coating material; and an inner region comprising at least one layer of a hard coating material wherein the hard coating material includes:

at least one transitional metal selected from the group consisting of the Groups IVa, Va, and VIa of the Periodic Chart, and silicon and nitrogen wherein the outer region comprises alternating layers of carbon and one transition metal selected from the group consisting of Groups IVa, Va and VIa of the Periodic Chart.

16. The coated cutting tool according to claim 15 wherein the transition metal in the outer region comprises a metal selected from the group consisting of titanium and chromium.

17. The coated cutting tool according to claim 16 wherein each one of the layers has a thickness between about 0.1 nanometer and about 500 nanometers.

18. A coated cutting tool for removing material from a workpiece, the cutting tool comprising:

a surfaces wherein the surfaces has a rake surface and a flank surface, a cutting edge is at the intersection of the rake and flank surfaces;

a coating on the cutting edge and on at least a portion of one or both of the rake surface and the flank surface of the surfaces;

the coating comprising an outer region wherein the outer region is in contact with the workpiece during a material removal operation;

the outer region comprising at least one layer of a tribological coating; and an inner region comprising alternating layers of:

a first material that contains a transition metal selected from the group consisting of Groups IVa, Va and VIa of the Periodic Chart, and nitrogen; and a second material that contains silken and nitrogen wherein the outer region comprises alternating layers of carbon and a transition metal carbide wherein the transition metal is selected from the group consisting of Groups IVa, Va and VIa of the Periodic Chart.

19. The coated cutting tool according to claim 18 wherein the transition metal in the outer region is selected from the group consisting of titanium and chromium.

20. A coated cutting tool for removing material from a workpiece, the cutting tool comprising:

a surfaces wherein the substrate has a rake substrate and a flank surface, a cutting edge is at the intersection of the rake and flank substrate;

a coating on the cutting edge and on at least a portion of one or both of the rake surface and the flank surface of the substrate;

the coating comprising an outer tribological region wherein the outer region is in contact with the workpiece during a material removal operation; and an inner region comprising alternating layers of:

a first material that contains titanium and aluminum and nitrogen, and a second material that contains silicon and nitrogen, the first material of the inner region comprises titanium aluminum nitride and the second material of the inner region comprises silicon nitride wherein the silicon nitride has the formula $SiN_x$ wherein x ranges between about 0.75 and about 1.333.

21. A coated cutting tool for removing material from a workpiece, the cutting tool comprising:

a substrate wherein the substrate has a rake surface and a flank surface, a cutting edge is at the intersection of the rake and flank surfaces;

a coating on the cutting edge and at least a potion of one or both of the rake surface and the flank surface of the substrate;

the coating comprising an outer tribological region wherein the outer region is in contact with the workpiece during a material removal operation; and inner region comprising alternating layers of:

a first material that contains titanium and aluminum and nitrogen, and a second material that contains silicon and nitrogen;

the first material of the inner region comprises titanium aluminum nitride and the second material of the inner region comprises silicon nitride wherein the silicon nitride has the formula $Si_3N_4$.

22. A coated cutting tool for removing material from a workpiece, the cutting tool comprising:

a substrate wherein the substrate has a rake surface and a flank surface, a cutting edge is at the intersection of the rake and flank surfaces;

a coating on the cutting edge and at least a portion of one or both of the rake surface and the flank surface of the substrate;

the coating comprising a hard coating region comprising alternating layers of a first material that comprises titanium aluminum nitride and the second material comprises silicon nitride wherein the silicon nitride has the formula $SiN_x$ wherein a ranges between about 0.75 and about 1.333.

23. A coated cutting tool for removing material from a workpiece, the cutting tool comprising:

a substrate wherein the surfaces has a rake surface end a flank surface, a cutting edge is at the intersection of the rake and flank surfaces;

a coating on the cutting edge and at least a portion of one or both of the rake surface and the flank surface of the substrate;

the coating comprising a hard coating region comprising alternating layers of a first material that comprises titanium aluminum nitride and the second material comprises silicon nitride wherein the silicon nitride has the formula $Si_3N_4$.

24. A coated cutting tool for removing material from a workpiece, the cutting tool comprising:

a surfaces wherein the substrate has a rake surface and a flank surface, a cutting edge is at the intersection of the rake and flank surfaces;

a coating on the cutting edge and on at least a portion of one or both of the rake surface and the flank surface of the substrate;

the coating comprising an outer region wherein the outer region is in contact with the workpiece during a material removal operation;

the outer region comprising at least one layer of tribological coating material; and an inner region comprising at least one layer of a hard coating material wherein the hard coating material includes:

at least one transitional metal selected from the group consisting of in Groups IVa, Va and VIa of the Periodic Chart and silicon and nitrogen, the inner region comprising alternating first and second layers wherein the first layer is titanium aluminum nitride and the second layer essentially consists of silicon nitride.

* * * * *